US006125794A

United States Patent [19]

Joshi et al.

[11] Patent Number: 6,125,794

[45] Date of Patent: Oct. 3, 2000

[54] SYSTEM FOR TRANSFERRING AND RECOVERING HEAT FROM PRODUCTS OF COMBUSTION

[75] Inventors: Narendra Dattatraya Joshi; Dilip Waman Bapat; Alten Carmo Lobo; Samir Vasudeo Kulkarni; Charles Philominraj, all of Pune, India

[73] Assignee: Thermax Limited, Maharashtra, India

[21] Appl. No.: 09/132,471

[22] Filed: Aug. 11, 1998

[51] Int. Cl.[7] ..... F02C 6/18

[52] U.S. Cl. ..... 122/7 R; 432/220; 60/39.07

[58] Field of Search ..... 122/1, 6 R, 7 R; 432/219, 220; 60/39.07

[56] References Cited

U.S. PATENT DOCUMENTS 4,431,403 2/1984 Nowak et al. ..... 431/183

FOREIGN PATENT DOCUMENTS 1 562 537 4/1969 France .
28 40 804 4/1980 Germany .
28 45 696 4/1980 Germany .
29 19 184 11/1980 Germany .
296 06 706 U 5/1996 Germany .
202063 3/1939 Sweden .
814 006 6/1959 United Kingdom .

*Primary Examiner*—Denise L. Ferensic
*Assistant Examiner*—Gregory A. Wilson
*Attorney, Agent, or Firm*—Venable; Robert Kinberg; Eric Weierstall

[57] ABSTRACT

A heat recovery system, the system having a fuel burner assembly. The fuel burner assembly having a pilot burner, an ignition source such as, an ignition transformer, a turbo compressed air inlet duct, a primary housing accommodating a burner rod and nozzle assembly and a secondary housing made of a combustion chamber, having an upstream secondary air mixing assembly and an air diffuser assembly.

The fuel burner assembly being operably connected down stream to a heat transfer and recovery system having one or more, preferably two, heat exchangers of the convective heat exchange type and an exhaust or stack for the exit of spent flue gases. The fuel burner assembly being operably connected upstream to a turbo charger/turbo compressor. The turbo charger/turbo compressor being provided with a start up mechanism, the start up mechanism comprising an air eductor assembly, external air supply feed line, an external fuel supply source, a liquid/gaseous fuel burner and a mixing chamber assembly. The start up mechanism operably connecting the start up mechanism to the turbo charger/turbo compressor and the heat recovery system.

8 Claims, 3 Drawing Sheets

SYSTEM FOR TRANSFERRING AND RECOVERING HEAT FROM PRODUCTS OF COMBUSTION

INTRODUCTION OF THE INVENTION

This invention relates to improvements in the design and construction of fired heaters, such as Steam Generators, Hot Water Boilers, Thermal Oil Heaters, Air Heaters, Hot Gas Generators or any other fluid heaters and also other equipment involving combustion such as Direct Fired Vapor Absorption Heat Pumps. In this invention these fired heaters are made compact by use of an innovative approach. It is a common knowledge that use of high velocity in the convection section of a heat transfer equipment will result in increased heat transfer coefficient which in turn will reduce heat transfer surface area. It is also known that if combustion chamber pressure is increased, it results in reduced flame dimensions. However, there is a great penalty of high pressure drop when combustion chamber pressure and flue gas velocities are increased. In this invention, it is envisaged that by combining previously known methods of generating high pressure air without use of external motive power, fired heaters could be made compact, by an order of magnitude change in their dimensions.

There is also provided a start up system for the above invention. A new burner assembly for the said improved configuration of fired heaters is also proposed.

Use of a turbo charger/turbo compressor is recommended in a novel manner.

BACKGROUND OF THE INVENTION

Conventionally, all the fired heaters such as Steam Generators, Thermal Oil heaters, Air Heaters, etc. have the following major components related to the process of heat transfer.

a) Burner for combustion of fuel;

b) Heat transfer surfaces, both in radiation and convection section. The radiation heat transfer surface is generally a flame enclosure, which also acts as a combustion chamber.

c) Fan or blower to take care of pressure drop (hydraulic resistance) of this system comprising burner as well as gas passage through heat transfer surfaces. (In case of natural draught system, the pressure drop is matched with the draft created by the stack).

There are practical limitations in designing these systems, due to the fact that high velocity in the convective section results in higher pressure drop and calls for high fan power. One is therefore forced to work out an optimal balance between fan power and velocity to be used in these fired heaters.

It is a well-known fact, that higher velocity in the convective section would give high heat transfer coefficient in the convection section. It is also known that the higher the pressure in the combustion chamber, the smaller will be the flame dimensions. It is however not practical to operate the combustion chambers beyond about 200–500 mm. wc as one has to pay penalty in the fan power, which increases the operating costs. This is generally a practice followed in designing fired heaters with a few exception, where high fan power is tolerated to gain advantage of reduced size of the heater if space is not available.

Thus, having arrived at a maximum allowable pressure drop in the system, one is forced to accept the size of furnace depending on flame dimensions and maximum possible velocity for the convection zone. The maximum velocity depends on available head.

The Turbo Charger/Turbo Compressor has been in use for many years and it is mainly used for boosting combustion air pressure and quantities for internal Combustion Engines (such as Diesel Engines). By use of Turbo Charger, Diesel Engines power is enhanced as a result of pumping more air into combustion chamber, which in turn, allows higher quantities of fuel to be fired for the same engine size. The Turbo Charger consists of a turbine section and compressor section running on the same shaft. The turbine section receives flue gases from the engine prior to exhaust, and the power generated due to drop in temperature and pressure of the flue gases is used solely for the purpose of compressing incoming combustion air.

In the current invention, it is envisaged that a Turbo Charger/Turbo Compressor be used in place of a fan for creating high pressure combustion air using residual temperature and pressure in the exhaust gases for generating power required for the compressor. Thus, it is envisaged that, a Turbo Charger can be gainfully used on the fired heaters which will result in substantial reduction in the size of fired heater.

On Internal Combustion Engines, the Turbo Charger need not be operative right from the beginning. The Engine can be started without Turbo Charger and it can run in a normal natural aspiration mode. Only when sufficient gas quantity and pressure is developed, Turbo Charger can be brought on-line. Thus, the start up system for IC Engines, has been well established. When the Turbo Charger is used on a fired heater, an innovative approach for start up is required. In the absence of a fan, there is no way of firing the burner when Turbo Charger is not in operation. The current invention also describes the new start-up system.

A combustion system consists of fuel fired burner. In a conventionally fired system, heaters operate at an air pressure which does not exceed approx. 500 mm. wc, and the burner designs are well established to operate under these pressure conditions. When a Turbo Charger is used, the combustion chamber will have to operate at a much higher pressure requiring different configuration of the burner. If the new fired heater with Turbo Charger is to be made compact, one need a compatible burner system. Therefore a new burner assembly is introduced for operating combustion chamber at much elevated pressure. It is suggested to make the fired heater—Turbo Charger Start-up System, suitable for firing multiple fuels like HSD, LDO, FO, LSHS etc. apart from gaseous fuels like natural gas, LPG, Biogas, etc.

Thus this invention in one aspect relates to improved heat transfer equipment.

In another aspect, this invention also relates to new start up system for use in the improved heat transfer equipment.

In a third aspect it relates to novel way of using Turbo charger/Turbo compressor system.

In a fourth aspect, this invention relates to a new burner assembly for use in the improved heat transfer equipment and other heat transfer equipment.

DESCRIPTION OF THE PRIOR ART AND DRAW BACKS

It is already known to have heat transfer equipment of the common type which are based on convective and radiative heat transfer.

Connective—cum—radiative heat transfer equipments, though used commercially, have characteristics/limitations/disadvantages of which a few are mentioned herein:

a) These require large size equipment and components which increases the initial cost of equipment, installation and space.

b) The heat transfer co-efficient is limited depending upon the flue gas conditions, particularly limited by velocity of the products of combustion (flue gases) in convective sections used for heat recovery.

c) There is certain electrical power requirement for the combustion air fan.

d) Certain amount of excess air level is required which has bearing on the overall efficiency.

e) The furnace has to be of a larger size in view of the large dimensions of length and diameter of the flame.

f) Flexibility of adopting to various applications is limited due to several constrains.

OBJECTS OF THE INVENTION

A shift in the design of the heat transfer equipment has been proposed in the form of a small dimensional improved heat transfer equipment.

It is, therefore, a principle object of this invention to propose an improved heat transfer equipment which will be compact and cost effective.

It is another object of this invention to propose such a heat transfer equipment which will ensure higher heat flux/heat transfer co-efficient than known art equipments.

It is yet another of this invention to propose such a heat transfer equipment which will need lesser heat transfer area than the known equipments and at the same time ensure higher heat flux/heat transfer co-efficient.

It is a further object of this invention to propose such a heat transfer equipment which will be of overall reduced size and weight compared to known equipments while ensuring the other objectives.

A still further object of this invention is to eliminate major part of electrical power consumption by providing a turbo charger/turbo-compressor in the system.

Yet, another object of this invention is to propose such a heat transfer equipment, which will need less operational costs thereby making the equipment and the process also more economical.

A further object of this invention is to propose such an improved heat transfer equipment, which will have greater flexibility of operation and flexibility of adaptation to various applications like steam generators, hot water generators, hot water generators, thermic fluid heaters, air heaters, hot gas generators, direct fired vapor absorption heat pumps etc.

A still further object is to propose such a heat transfer equipment which can also be adopted for multiple fuels like HSD, LDO, FO, LSHS etc. or any other comparable liquid fuels as well as gaseous fuels like naturals gas, bio-gas, LPG etc.

It is a yet another object to propose a new start-up mechanism for initial cranking of turbo charger/turbo compressor suited to and compatible with improved heat transfer equipment.

A still further object is to propose a new burner design to provide a more efficient burning with flame dimensions smaller than those known in the art.

In addition, the invention also has the object of proposing an improved process for heat transfer which ensures higher or improved heat flux/heat transfer co-efficient and requires an overall smaller size equipment than known in the art and does not require electrical power for blowing combustion air through the equipment and at the same time has greater flexibility to be adaptable to various applications such as steam generator, hot water generator, thermic fluid heater, air heater, hot gas generator, direct fired vapor absorption heat pump etc and similar applications with ease and economy.

These and other objects of the invention will be more clear from the following paragraphs.

According to this invention there is provided a method for the recovery of heat from products of combustion (flue gases) of a fuel, at a higher temperature to another fluid at a relatively lower temperature comprising the following steps.

(i) increasing the velocity of the hot flue gases, from combustion of a fuel multifold than hitherto possible, by means of feeding compressed air powered by a turbo charger/turbo compressor to the fuel, in the burning stage;

(ii) subjecting the fuel cum high pressure air to a step of burning in an enclosure;

(iii) adjusting the fuel burning rate vis-a-vis the quantity/pressure of air to achieve steady state burning condition;

(iv) producing and maintaining a steady flame of dimensions (length diameter) considerably smaller than hitherto possible in said burning enclosure;

(v) recovering and indirectly transferring a small part of the heat of combustion to a relatively colder external fluid held surrounding the said burning enclosure;

(vi) passing the products of combustion through a first heat exchanger;

(vii) recovering and indirectly transferring a major part of the heat of the products of combustion, predominantly by convective heat transfer in said first heat exchanger, to the external fluid, which is the same said fluid which surrounds the burner enclosure or is a different fluid altogether;

(viii) passing the partly heat depleted flue gases coming out of said first heat exchanger through a turbine of turbo charger/turbo compressor and converting partial thermal energy content of flue gases into mechanical energy in turbine of turbo charger/turbo compressor which in turn is utilized to compress fresh air to high pressure in compressor of turbo charger/turbo compressor mounted on to the same shaft of the turbine of turbo compressor to be used as combustion air in the burner in applications specified thereof and then through a second heat exchanger;

(ix) receiving and indirectly transferring further heat from and said partly heat depleted flue gases in the second heat exchanger to the external fluid, which is the same said fluid which surrounds the burner enclosure and first heat exchanger or is a different fluid altogether;

(x) recovering substantially all the remaining heat through said second heat exchanger also through convective heat transfer and finally;

(xi) allowing all the heat depleted flue gases to pass to an exhaust stack.

The turbo compressed air is at a pressure of 0.3 to 3 barg and the velocity of the flue gases in the heat transfer section is between 50–2000 m/sec., the proportion of the compressed air fed to the fuel at the burning stage being preferably in the range of 15.5:1 to 19:1.

The fuel is selected from, but not restricted to, HSD/LDO/FO/LSHS etc. or gaseous fuels like LPG/Natural Gas etc. and is ignited by a pilot gas burner which in turn is ignited with the help of ignition sparks through a ignition transformer.

The air is fed to the burning flame at different stages in said burning enclosure. A system for transferring and recovering heat from products of combustion (flue gases ) of a fuel in radiant and two stage convection section comprising in combination, (i) A fuel burner assembly operably connected upstream to a turbo charger/turbo compressor, said turbo charger/turbo compressor being provided with a start up mechanism, said fuel burner assembly operably connected down stream to a heat transfer and recovery system having one or more, preferably two, heat exchangers of the convective heat exchange type and an exhaust or stack for the exit of spent flue gases, said start up device comprising an air eductor assembly, external air supply feed line, an external fuel supply source, a liquid/gaseous fuel burner and a mixing chamber assembly operably connecting said start up device to said turbo charger/turbo compressor, and said heat recovery system, said fuel burner assembly comprising a pilot burner, an ignition source such as an ignition transformer, a turbo compressed air inlet duct, a primary housing accommodating a burner rod and nozzle assembly and a secondary housing made of a combustion chamber, having upstream secondary air mixing assembly and an air diffuser assembly.

The two convective heat exchangers and said combustion chamber are held together accommodating a common fluid in the same enclosure or different fluids as herein described in separate enclosures to absorb heat by radiative/convective heat transfer.

The system is not restricted to, a steam generator, hot water generator, thermic fluid heater, air heater, hot gas generator, direct fired vapor absorption heat pump or similar equipments or combination thereof to cover various arrangements of heat transfer surfaces including but not restricted to a flue tube construction.

The housing of the burner assembly is provided with a flame detection device and a view port at appropriate location.

The secondary housing has a leading divergent section, the said section having a plurality of secondary air feeding ports or nozzles adopted to inject the secondary air at an appropriate angle to the transverse axis of the flame.

A start up device, for use in a system for transferring and recovering heat from products of combustion (flue gases) of a fuel by the method as herein described, comprising an air supply assembly such as eductor, external air supply feed line an external fuel supply source, a start up burner and a mixing chamber assembly operably connecting said start up device to said turbo charger/turbo compressor and said heat recovery system.

A burner assembly for use in a system for transferring and recovering heat from products of combustion (flue gases) of a fuel by the method as herein described, comprising a pilot burner, an ignition source such as an ignition transformer, a turbo compressed air inlet duct, primary housing accommodating a burner rod and nozzle assembly, and a secondary housing having up stream, secondary air mixing assembly and an air diffuser assembly.

The burner assembly is provided with a flame detection device and a view port at appropriate locations.

The secondary housing has a leading divergent section, said section having plurality of secondary air feeding ports or nozzles adopted to inject the secondary air at an appropriate angle to the transverse axis of the flame.

SUMMARY OF THE INVENTION WITH REFERENCE TO THE ACCOMPANYING DRAWINGS

The invention is now described with the help of FIG. 1, FIG. 2 and FIG. 3.

FIG. 1 shows a block diagram of the preferred arrangement of heat transfer equipment of the fired heater, based on the newly invented technology.

FIG. 2 shows the preferred arrangement of new burner system.

FIG. 3 shows the new start-up system for initial cranking of Turbo Charger/Turbo Compressor.

These are only preferred arrangements and the present invention includes, but is not restrtricted to, these arrangements. There could be variations in these arrangements/configurations. However, the current invention envisages use of all these arrangements/configurations in which, a Turbo Charger/Turbo Compressor is used in place of fan or a blower for providing combustion air at an elevated pressure with a sole purpose of making the fired heater compact by operating combustion chamber at high pressure and convection section at high velocity.

BRIEF DESCRIPTION OF THE DRAWINGS

The invention will now be more fully described with reference to the accompanying drawings which illustrate the broad concept with reference to a particular Application only and is not be considered as limited thereof.

In the drawings.

DETAILED DESCRIPTION OF THE DRAWINGS

Figure 1:
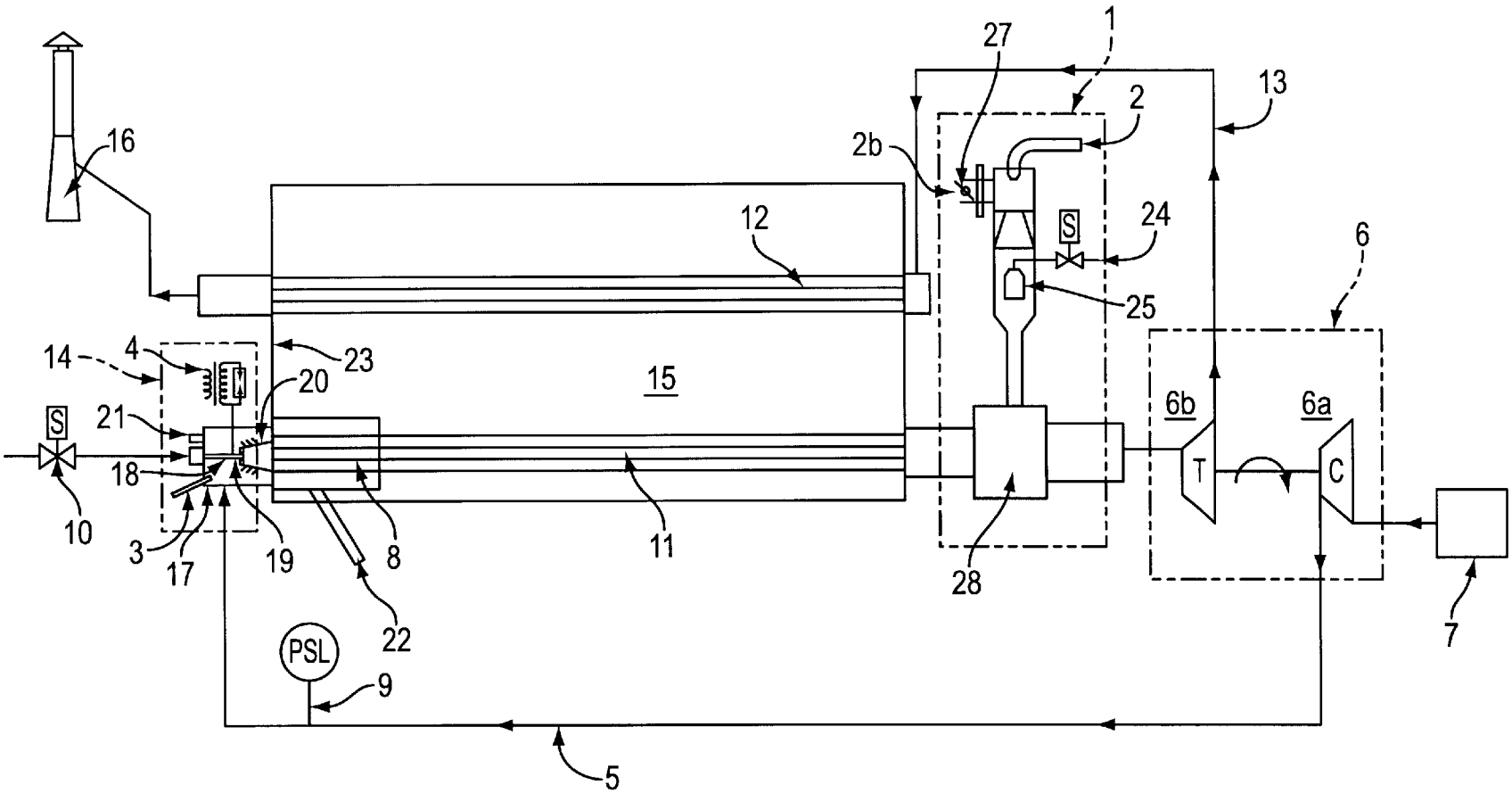
FIG. 1 shows the block diagram for heat transfer equipment based on newly invented technology.
Figure 2:
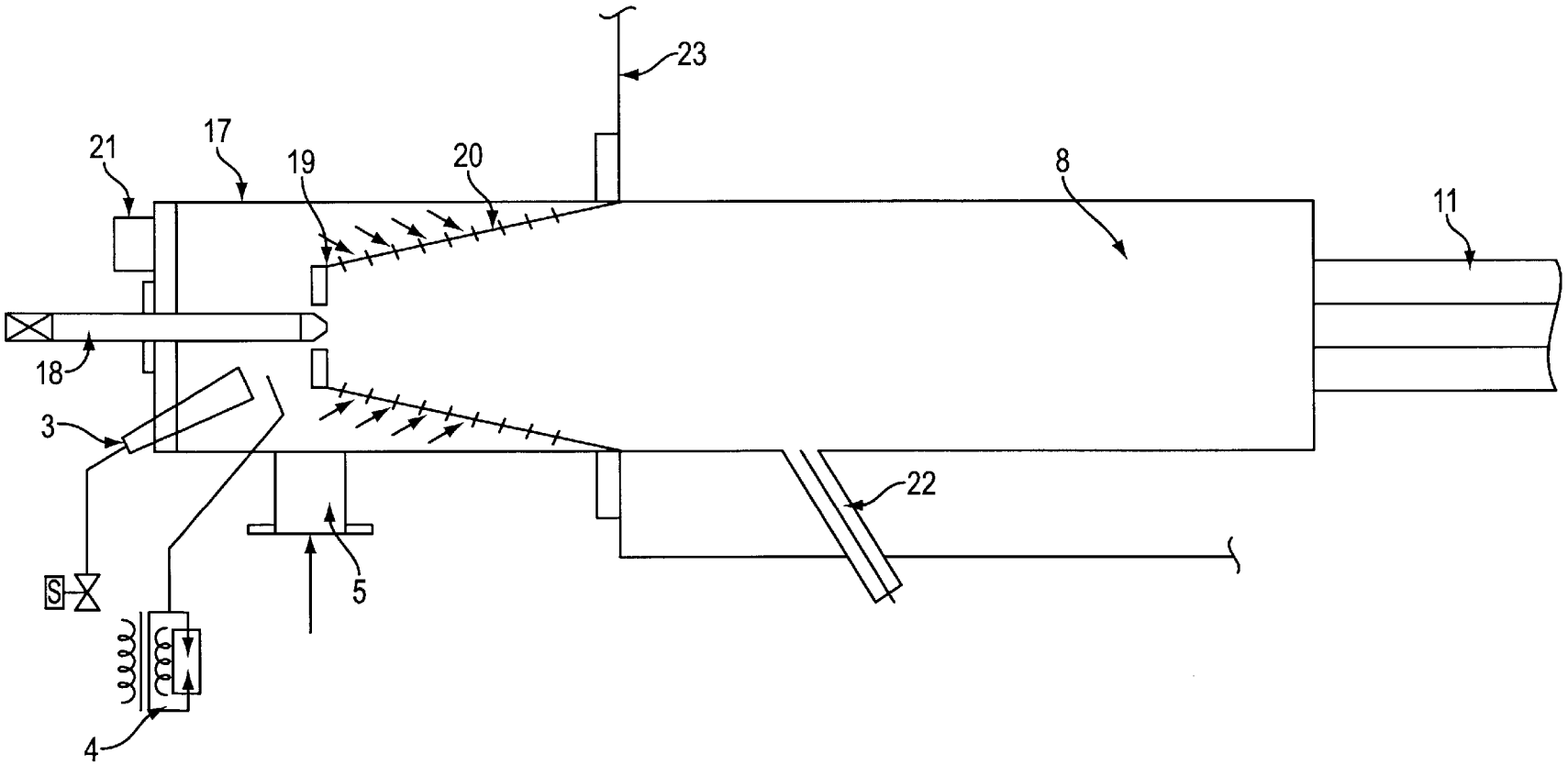
FIG. 2 shows the new burner used in the equipment.
Figure 3:
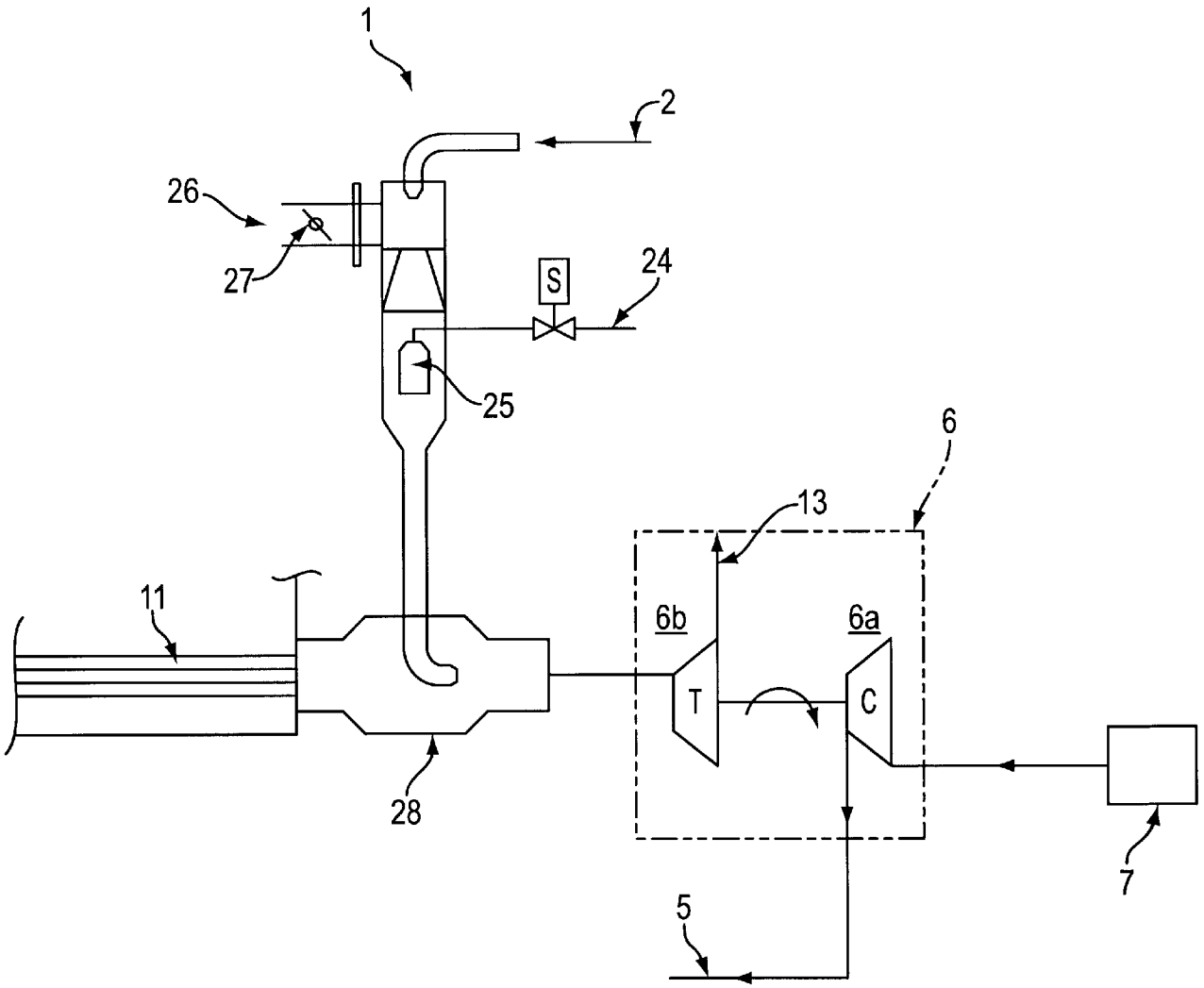
FIG. 3 shows the new startup system developed for initial cranking of the turbo charger/turbo compressor.

FIG. 1 pertains to the total system of the newly invented heat transfer equipment wherein startup system (1) the details of which are shown in FIG. 3 and described in the following paragraphs,uses the external air source(2) for cranking the turbo compressor (6) initially. The external air source (2) is utilized for less than 60 seconds only. The air generated by the compressor**(6*a*) is available for burning fuel in the newly invented burner (14) the details of which are shown in FIG. 2 and described in the following paragraphs. After achieving sufficient pressure at the air inlet duct of the burner, which is sensed by the pressure switch (9) the pilot burner (3) is fired with the help of ignition spark in pilot gas path through ignition transformer (4). The fuel solenoid valve (10) is switched on and the fuel starts burning in the combustion chamber (8). The energy released by the fuel further increases the speed of the turbo compressor (6) and allows it to run in stable, self sustained condition. The startup system (1) is switched off after achieving stable speed. The fuel firing rate is further increased. With the increase in fuel firing rate, the turbo compressor (6) achieves higher speed and correspondingly more air is made available for combustion. At full firing rate the rated speed of the turbo compressor (6) is achieved. The compressor (6*a*) of the turbo compressor (6) sucks fresh air through the air filter (7) and delivers it to the burner (14) at rated pressure and flow through the ducting (5). The burner (14) produces a very short flame within the combustion chamber (18). A small part of the heat is transferred to the outside fluid (15) around the combustion chamber (8). The products of combustion produced are driven through first compact heat exchanger (11) and heat is transferred through convective heat transfer to the fluid outside (15). Sizing of the first exchanger (11) is based on high velocity flue gases to achieve high heat transfer coefficient and suitable conditions of pressure and temperature at the entry of the turbine (6*b*) of the turbo compressor (6). The enthalpy of the flue gases available at the entry of the turbine (6***b*) is sufficient to rotate the turbine and in turn the compressor (6*a*) to make the system self sustainable without any external electrically driven fan. The flue gases coming out of the turbine (6*b*) are then passed through intermediate ducting (13) to second compact heat exchanger (12). The remaining heat energy is further transferred to the fluid outside (15). Sizing of the second heat exchanger (12) is based on high velocity of the flue gases to achieve high heat transfer coefficient and achieve optimum utilization of the heat content in the flue gases before being exhausted to the stack (16). The external fluid (15) can be same or different for heat exchangers (11) & (12) by suitable provisions as necessary.

FIG. 2 pertains to the newly invented burner as a part of the total system indicated in FIG. A. The burner (14) consists of housing (17) burner rod and nozzle assembly (18), pilot burner (3), ignition transformer (4), air inlet-duct (5). primary air diffuser assembly (19), secondary air mixing assembly (20), view port (21) and flame detection device (22). The flame produced by burner is accommodated in combustion chamber (8).

The housing (17) is designed to withstand the high pressure of the combustion air. It is mounted on the walls of the heat transfer equipment (23). The burner rod and nozzle assembly (18) is of air/steam atomized type. A gas fired pilot burner (3) is used for initial ignition of the main fuel. The pilot gas is ignited with help of an ignition transformer (4). The air required for combustion of the main fuel is received from the compressor (6*a*) of the turbo compressor (6) through the air inlet duct (5). The primary air diffuser assembly (19) produces strong turbulence to achieve thorough mixing of the primary air and the main fuel. The secondary air mixing assembly (20) consists of a number of small opening at an appropriate angle which forces secondary air at high velocity to the flame. This particular arrangement completes the combustion instantly and within a small space. This arrangement helps in confining the flame within the combustion chamber (8). The combustion chamber is further connected to the first compact heat exchanger (11). The flame detection device (22) senses the flame and gives signal to the control system to continue the process. The flame can also be viewed through the view port (21) provided on the housing (17) of the burner.

FIG. 3 pertains to the details of the new startup system as a part of the total system as indicated in FIG. 1. The startup system (1) consists of external air supply (2), fuel supply pipe (24), startup burner (25), suction port (26), butterfly damper (27) and mixing chamber assembly (28).

A small quantity of air at high pressure of approximately 5 barg., is supplied by external air supply assembly (2). Due to the suction created by the device such as an eductor, almost double the quantity of air is sucked from the atmosphere through the suction port (26) and butterfly damper (27). The total air combined from external source (2) and suction port (26) is sufficient as combustion air for burning the startup fuel supplied through the fuel supply pipe (24) of the startup burner (25). The products of combustion from the startup burner (25) are passed onto the mixing chamber assembly (28) at high temperature around 650° C. The mixing chamber assembly is connected between the first compact heat exchanger (11) and turbo compressor (6). The energy content of the products of combustion is sufficient for initial cranking of the turbine (6*b*) of turbo compressor(6). With the initial rotation of the turbine (6*b*) and subsequently the compressor (6*a*), air is sucked by the compressor (6*a*) through air filter (7) and is delivered to the main burner (14) through air ducting (5). The quantity of air sucked by the compressor (6*a*) is sufficient for initiating the combustion in the main burner (14), the speed of turbo compressor (6) increases and attains a stable condition where its operation becomes self sustainable. The startup procedure is completed at this point and the fuel supply to the start up burner (25) is switched off. External air supply (2) is switched off and butterfly damper (27) at the suction port (26) is closed.

DETAILED EXPERIMENTAL VERIFICATION OF THE INVENTED PROCESS/EQUIPMENT

A) In order to practically verify achievement of the several objects of this invention, two equipments of same thermal output, one based on conventional technology and the other based on the invention were set up.

The above concept has been verified under identical conditions by experimental studies on the above set ups. Results for typical configuration are as under:

TABLE 1

| | Conventional | New |
|---|---|---|
| Flame dimensions | | |
| Diameter | D1 | 0.3 D1 |
| Length | L1 | 0.25 L1 |
| Furnace dimensions | | |
| Diameter | D2 | 0.4 D2 |
| Length | L2 | 0.3 L2 |
| Heat transfer surface area, m2 | A | 0.3 A |
| Over all heat transfer coefficient, kcal/hr. m2 ° C. | h | 4 h |
| Over all thermal efficiency based on GCV, % | 83.5 | 84.5 |

B) In order to verify/compare part load performance further experiments were conducted and results for typical configuration are as under:

TABLE 2

EXPERIMENTAL DATA

| | Load on system as % of design condition | | | | | |
|---|---|---|---|---|---|---|
| | Conventional | | | New | | |
| Parameters | 100 | 74 | 50 | 100 | 74 | 50 |
| Combustion air pressure, kPa | P1 | P2 | P3 | 51 P1 | 31 P2 | 25 P3 |
| Total hydraulic resistance of heat exchanger equipment (excluding turbine in case of new technology), kPa | DP1 | DP2 | DP3 | 14 DP1 | 12 DP2 | 7 DP3 |
| Electrical power consumption for blowing combustion air, kW | P | 0.9 P | 0.8 P | Nil | Nil | Nil |
| Enthalpy drop across turbine KJ/S | NA | NA | NA | W | 0.57 W | 0.43 W |
| Enthalpy rise across compressor KJ/S | NA | NA | NA | W | 0.57 W | 0.43 W |
| % O2 in flue gases (dry vol.) | 4.4 | 5.1 | 6.3 | 2.0 | 3 | 3.4 |
| Excess air level, % | 25 | 30 | 40 | 10 | 15.5 | 18 |

NA - Not Applicable

COMPARISON OF THE DATA PRESENTED IN TABLE 1 & 2 AND CONCLUSIONS

From the data available and observations on flame size/shape, heat transfer surface area, combustion air pressure etc. it is concluded that the claims made in the present invention have been verified practically and that it is possible to reduce furnace dimensions/heat transfer area by an order of magnitude by using this new concept without the need of externally powered combustion air fan.

These are only typical results and similar enhancement is possible for other arrangements/configurations/applications.

DETAILED DESCRIPTION OF THE PROCESS OF THE INVENTION

Conventionally, the heat transfer equipments used for the applications such as steam generator, hot water generator, thermic fluid heater, air heater, hot gas generator direct fired vapor absorption heat pumps etc. make use of radiative as well as convective heat transfer. The combustion equipment used in the system is a conventional burner which produces a substantially large flame. The combustion chamber (furnace) is designed to accommodate the flame produced by the conventional burner. The electrically, driven fan is used to supply combustion air through the burner and drive the products of combustion through combustion chamber and convective heat transfer surfaces. The size of combustion chamber is quite large due to limitation imposed by flame dimensions. The convective heat transfer surface and overall heat transfer equipment is quite large due to limitations imposed by power requirement for fan. The conventional burners require about 20–25% excess air for completing the combustion of fuel. The heat transfer surface area requirement is quite high due to comparatively low heat transfer coefficients.

The attention was directed towards realizing more heat transfer per unit area under a given set of conditions by an improved process as compared to known process.

In order to achieve the above objectives, it was decided to enhance the convective heat transfer by increasing the velocity of products of combustion over the heat transfer surface. The velocity of products of combustion (flue gas) was increased to a level of 50 to 200 m/sec as compared to much lower level of velocity in conventional systems. The combustion air pressure was increased to overcome the resultant hydraulic resistance in the heat transfer equipment and also to achieve reduction in flame size.

This resulted in the reduction of the heat transfer area and hence in the size of the heat transfer equipment like steam generators, hot water generators, thermic fluid heaters, air heaters, hot gas generators, direct fired vapor absorption heat pumps etc.

Usage of higher flue gas velocities increases the heat flux/heat transfer coefficient several times. This results in substantial reduction in the heat transfer area and hence the size of the heat transfer equipment could be reduced several times.

The increase in flue gas velocity also increases the hydraulic resistance in the flue gas path considerably compared to conventional, radiative and convective heat transfer equipments. Air at substantially higher pressure is required to overcome this resistance. This is catered to by using a Turbo charger/turbo compressor in the flue gas path. The high pressure air also considerably improves the combustion characteristics of fuels. The use of turbo charger/turbo compressor also eliminates the need for electrically driven fan which otherwise is a compulsory component in the conventional heat transfer equipments.

In a turbo charger/turbo compressor, the turbine utilizes energy from the flue gases to drive the compressor mounted on the same shaft. The total enthalpy loss of flue gases to provide motive energy to the turbine of turbo charger/turbo compressor is regained as enthalpy rise of the compressed air generated by the compressor of turbo charger, turbo compressor which in turn is delivered as combustion air to the system. Thus there is no loss of energy external to the system. Further heat is recovered from the flue gases at the outlet of the turbine of the turbo charger/turbo compressor to reduce the flue gas temperature to a level comparable to any conventional heat transfer equipment.

To realize the objective of compact heat transfer equipment, it was also necessary to develop a new burner system which can accept combustion air at high pressure and also considerably reduce the flame dimensions. A new burner system was designed to accomplish these objectives.

To accomplish the start up of the above mentioned equipment, a new hitherto unknown mechanism is used. The turbo charger/turbo compressor used in the system is cranked initially with the help of external air source for a period of less than 60 seconds. Within this period, the operation of turbo charger/turbo compressor becomes self sustaining and the external air source is removed.

What is claimed is:

1. A system for transferring and recovering heat from products of combustion (flue gases) of a fuel in radiant and two stage convection section comprising in combination, (i.) a fuel burner assembly operably connected upstream to a turbo charger/turbo compressor, said turbo charger/turbo compressor being provided with a start up device, said fuel burner assembly operably connected down stream to a heat transfer and recovery system having at least one heat exchanger of the convective heat exchange type and an exhaust or stack for the exit of spent flue gases, said start up device comprising an air eductor assembly, external air supply feed line, an external fuel supply source, a liquid/gaseous fuel burner and a mixing chamber assembly operably connecting said start up device to said turbo charger/turbo compressor, and said heat recovery system, said fuel burner assembly comprising a pilot burner, an ignition source, a turbo compressed air inlet duct, a primary housing accommodating a burner rod and nozzle assembly and a secondary housing made of a combustion chamber, having upstream secondary air mixing assembly and an air diffuser assembly.

2. A system as claimed in claim 1 wherein the said two convective heat exchangers and said combustion chamber are held together accommodating a common fluid in same enclosure or different fluids as herein described in separate enclosures to absorb heat by radiative convective heat exchange.

3. A system as claimed in claim 1 which is, but not restricted to, a steam generator, hot water generator, thermic fluid heater, air heater, hot gas generator, direct fired vapor absorption heat pump or similar equipments or combination thereof to cover various arrangements of heat transfer surfaces including but not restricted to a flue tube construction.

4. A system as claimed in claim 1 wherein the housing of the burner assembly is provided with a flame detection device and a view port at appropriate location.

5. A system as claimed in claim 1, wherein said secondary housing has a leading divergent section, the said section having a plurality of secondary air feeding ports or nozzles adopted to inject the secondary air at an appropriate angle to the transverse axis of the flame.

6. The system of claim 5, wherein said primary housing of the burner assembly is provided with a flame detection device and a view port.

7. The system of claim 1, wherein said secondary housing has a leading diversion section, said section having a plurality of secondary air feeding ports or nozzles adapted to inject the secondary air at an appropriate angle to the transverse axis of the flame.

8. The system for transferring and recovering heat from products of combustion (flue gases) of a fuel in radiant and two stage convection section of claim 1, wherein said ignition source is an ignition transformer.

* * * * *